US005092909A

United States Patent [19]

Werner et al.

[11] Patent Number: 5,092,909

[45] Date of Patent: Mar. 3, 1992

[54] BIODESULPHURIZATION PROCESS UTILIZING BACTERIA

[75] Inventors: Roy H. Werner, Pittsburgh; Clifford J. Decker, Bethel Park, both of Pa.

[73] Assignee: Barrett Haentjens & Co., Hazleton, Pa.

[21] Appl. No.: 449,320

[22] Filed: Dec. 11, 1989

Related U.S. Application Data

[63] Continuation-in-part of Ser. No. 273,588, Nov. 21, 1988, abandoned.

[51] Int. Cl.[5] ..... C10L 9/10

[52] U.S. Cl. ..... 44/622; 44/621; 435/262

[58] Field of Search ..... 44/622, 624, 625, 621; 435/262, 282

[56] References Cited

U.S. PATENT DOCUMENTS

| | | | |
|---|---|---|---|
| 4,134,737 | 1/1979 | Yang | 44/624 |
| 4,206,288 | 6/1980 | Detz et al. | 44/625 |
| 4,456,688 | 6/1984 | Dugan et al. | 44/624 |
| 4,562,156 | 12/1985 | Isbister et al. | 435/282 |
| 4,632,906 | 12/1986 | Kopacz | 435/282 |
| 4,659,670 | 4/1987 | Stevens, Jr. et al. | 44/625 |
| 4,775,627 | 10/1988 | Attia et al. | 435/282 |

*Primary Examiner*—Carl F. Dees
*Attorney, Agent, or Firm*—William J. Ruano

[57] ABSTRACT

Method and apparatus for treating sulphur bearing coal comprising pulverizing the coal, mixing it with water, a reagent and free air and pumping the resulting mixture to a classifier to separate the coal from sulphur and clay, all at the mine site. The resulting pure coal slurry is then pumped to a plant site where it is mixed with acid and bacteria. The resulting slurry is pumped to a bacteria digester wherein it is recirculated to provide maximum contact of bacteria and coal, completing the removal of sulphur. The resulting slurry is introduced into a mixer wherein the bacteria is neutralized by a reagent, raising the pH above 7 to destroy the bacteria and simultaneously aerating the mixture to treat the effuent. The desulphurized coal is treated by drying apparatus to provide a final purified coal product.

1 Claim, 4 Drawing Sheets

BIODESULPHURIZATION PROCESS UTILIZING BACTERIA

This application is a continuation-in-part of application Ser. No. 07/273,588, filed Nov. 21, 1988, now abandoned.

This invention relates to a continuous method of treating sulphur bearing coal from the mining thereof to a final purified product useful for a non-polluting fuel, or for any process requiring purified coal.

BACKGROUND OF THE INVENTION

Present coal treatment methods involve considerable handling and transportation expenses and often result in fuel contaminated with sulphur.

SUMMARY OF THE INVENTION

An object of the invention is to reduce the sulphur content of the coal, to overcome environemental problems, by utilizing a biodesulphurization process employing bacteria to form a highly purified coal, suitable for use as a non-polluting fuel, or process.

DETAILED DESCRIPTION OF THE PREFERRED EMBODIMENTS MINE SITE APPARATUS

Figure 1:
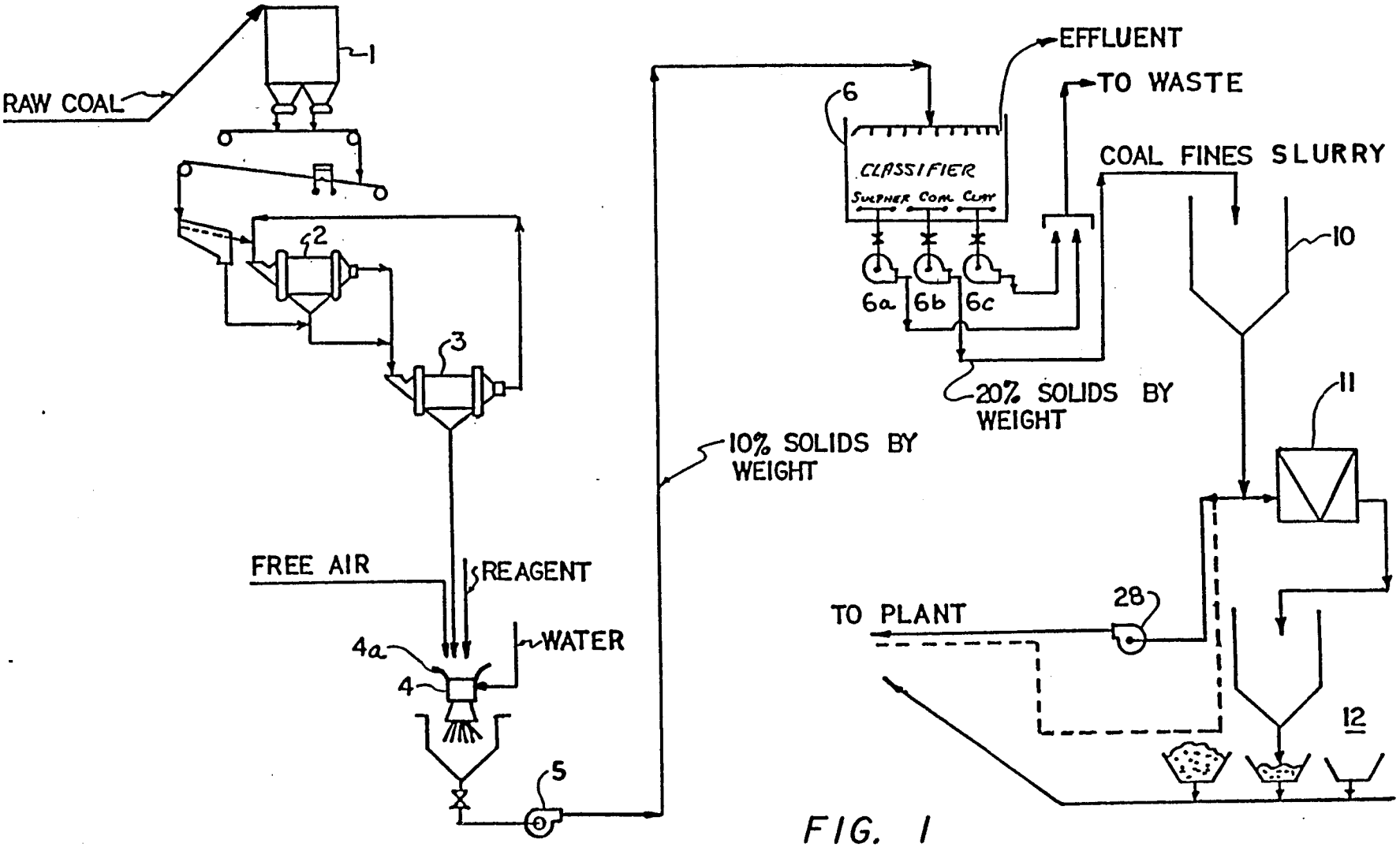
FIG. 1 is a schematic diagram of the initial portion of the present method located at the mine site.

Referring to FIG. 1, raw coal is mined and conveyed to a raw coal silo 1 on the mine surface. After the coal is crushed by crusher 2 to ⅜ inch or less, further reduced by pulverizer 3 to minus 200 mesh, the fine coal is gravity fed to the outwardly flared and curved inlet bore 4*a* of the mixer of the type described in Werner et al. U.S. Pat. No. 4,761,077 dated Aug. 2, 1988 assigned to the present assignee.

The mixer 4 instantly mixes coal fines, a reagent, water and free air to approximately a 10 percent solids by weight slurry. The slurry is pumped by pump 5 to classifier 6.

When classifier 6 is located at the mine site, sulphur and clay fines can be pumped underground to eliminate unsightly surface environmental problems. Location of classifier 6 at the mine site also reduces shipping costs, refuse handling and treatment at the plant site.

Referring to FIG. 1, classifier or settling basin 6 is designed to drop out the high density material containing pyritic sulphur in the front of the rectangular tank; coal fines in the middle, and clays at the end.

The method for classifying solid particles suspended in a liquid dispersion into discrete fractions here involves laterally injecting the liquid dispersion containing the solid particles into classifier or settling basin 6 with a sufficient velocity to cause particles of differing settling characteristics (fall velocity) to settle in different portions along the floor of the basin, applying a reduced pressure separately and in sequence to particles settled in the various zones to withdraw the same from the basin, and withdrawing a supernatant liquid effluent from the basin. The particles may be withdrawn by a series of pumps through pipes provided with valves operating from a controller.

The classifier is designed to settle the solids without using harmful chemicals to the bacteria, such as sulfolobus bacteria, which will be introduced later in the process.

Each section of the classifier 6 is programmed to remove the pyrites, coal fines and clays with its own pumping system 6*a*, 6*b* and 6*c*. Separate underwater settled solids level sensing devices are used to control the withdrawal rate of the high density material and the clays. A nuclear density meter (not shown) regulates the specific gravity, coal slurry being pumped from the classifier by controlling the speed of pump 6*b*. The coal underflow is thus withdrawn from the classifier at approximately a 20 percent solids by weight consistency. The pyrites and clays are pumped directly to the waste or disposal area. The coal is pumped to storage tank 10, a dewatering centrifuge 11, thence to a coal silo and coal loading area 12. Alternately, pump 28 can directly transfer the clean coal slurry to the plant site.

PLANT SITE APPARATUS

Figure 2:
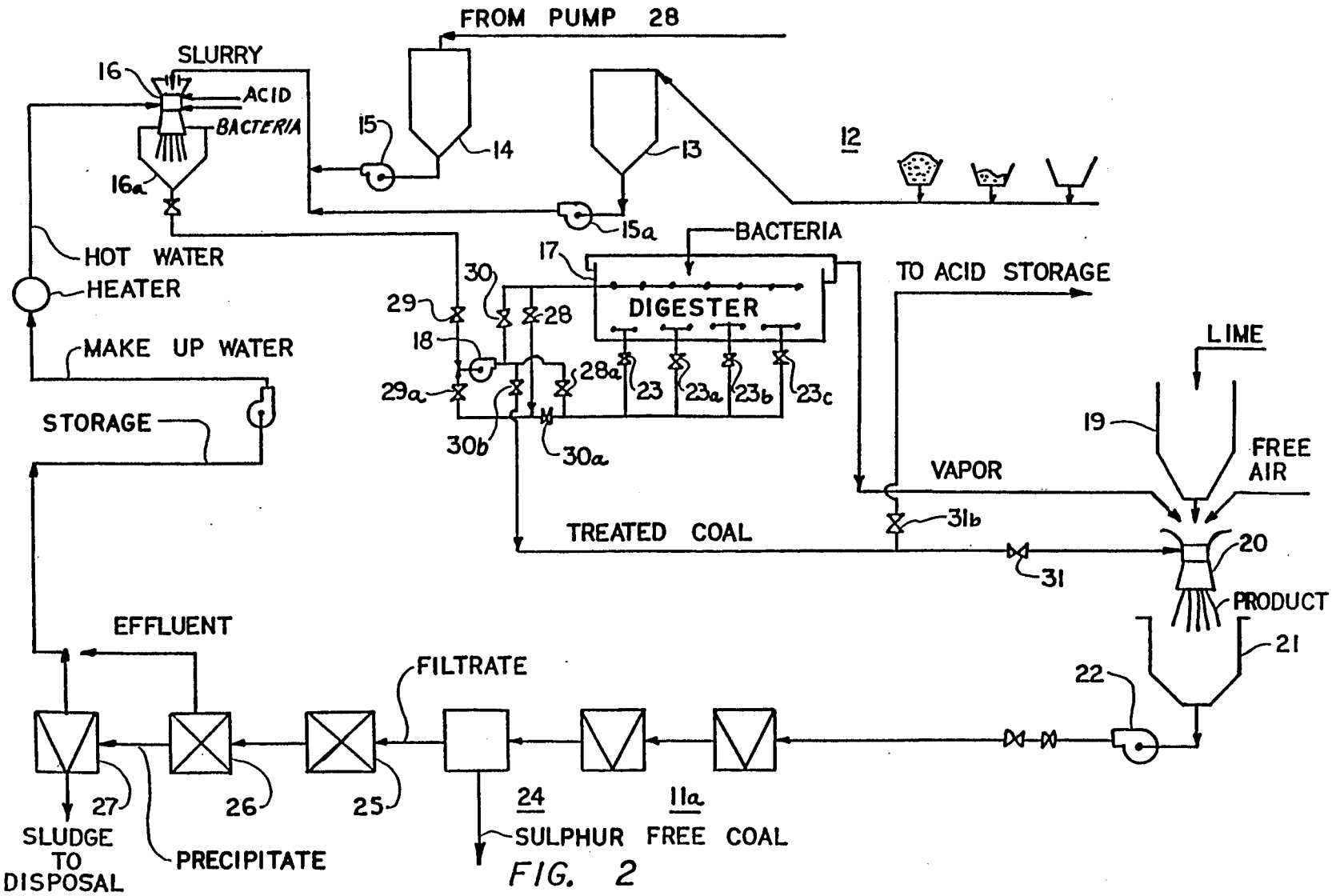
FIG. 2 is a schematic diagram of the method located at the plant site.
Figure 3:
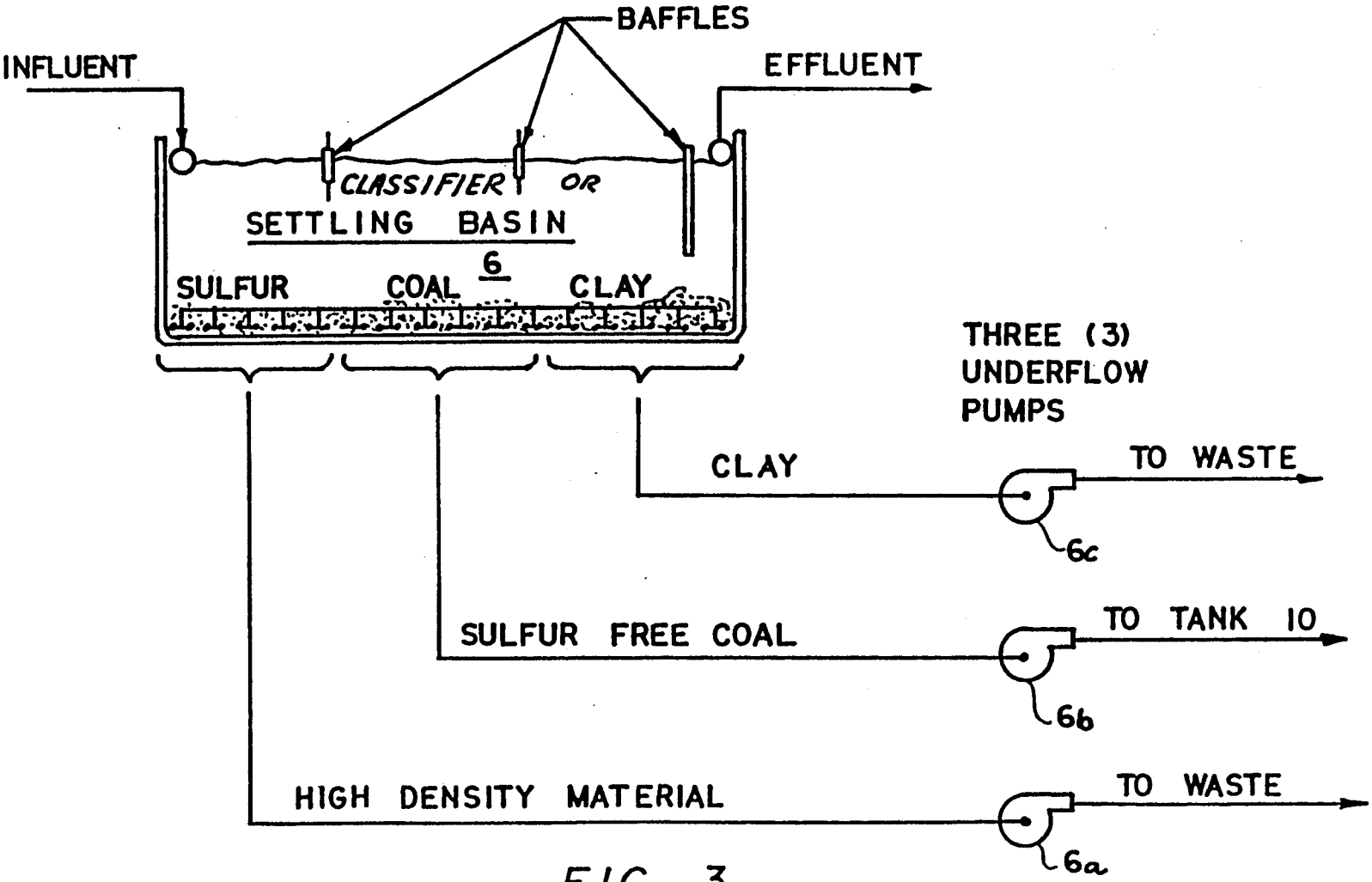
FIG. 3 is a schematic diagram of the details of the classifier, and how the solids are selectively removed from the classifier.

Referring to FIG. 2, the coal received by transport 12 is transferred to tank 13 and pumped by pump 15*a* to mixer 16. Alternately, if the coal is directly transferred by pumping, either by pump 6*b* (FIG. 3) or through pump 28, it is received at tank 14 as a 20 percent by weight slurry. If received by truck or train transport, the coal is reconstituted to a 20 percent slurry by the addition of water at tank 13. The flared inlet of mixer 16 is closed to prevent aeration.

The 20 percent coal slurry is pumped to mixer 16 through an inlet pipe extending through a closure cap on the flaired inlet of the mixer to be mixed without free air but with microorganisms, such as solfolobus bacteria, to remove organic and remaining pyritic sulphur from the coal while retaining its fuel value. To maintain a suitable environement for the microorganisms to consume the sulphur, an acid solution is used such as sulphuric acid (HsSO4) in the amount to maintain pH range of 3.0 to 4.0.

Figure 4:
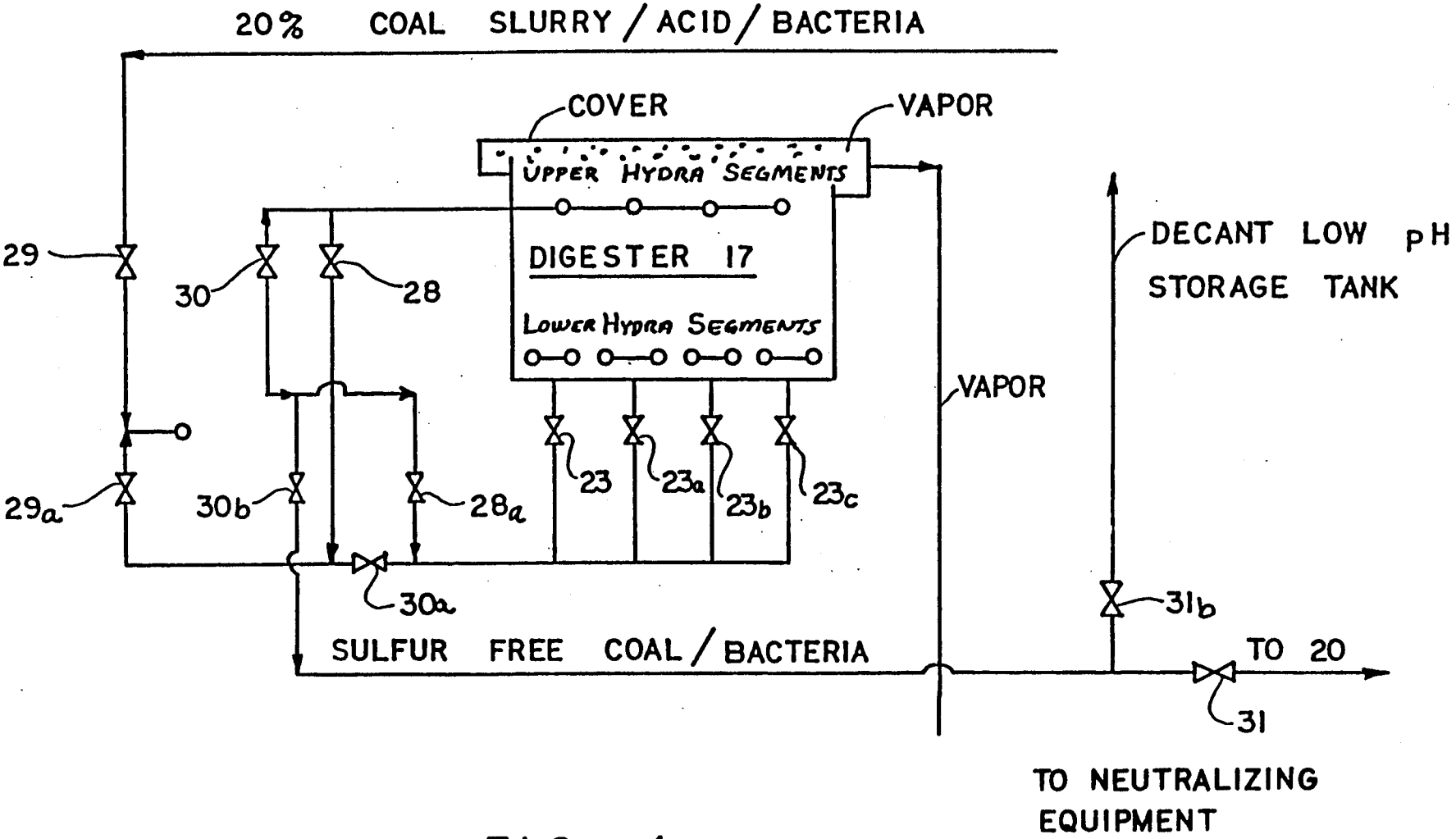
FIG. 4 is a schematic diagram of the details of the digester, and how the low pH coal slurry and bacteria are circulated for maximum contact of the coal fines with the bacteria; decant low pH liquid for reuse; recirculate neutralized slurry to digester; and dewater the neutralized slurry for further processing.

The acid/coal slurry is pumped by pump 18 to the disgester 17. Each rectangular digester is designed to process the desired tons per hour of raw coal, however multiple units can be made for any capacity. Microorganisms are introduced at mixer 16 and the coal is retained in the digester for approximately one day. During this period, by controlling valves 23, 23*a*, 23*b*, 23*c*, 29, 29*a*, 30, 30*a* and 30*b*, the pump 18 is used to recirculate mixture from the upper Hydra segment to the lower Hydra segment, or from lower to the upper segments to facilitate bacterial action as shown in FIG. 4. The upper Hydra segments will have a similar valving arrangement as the lower Hydra segments for maximum circulation distribution and withdrawal.

Since approximately 24 hours are required for complete bacterial action to remove the organic and pyritic sulphur, to make a continuous process a number of digesters will be required. These can be identified as 17*a*, 17*b*, etc. (not shown)

After recirculating the necessary hours, the slurry is permitted to settle at the bottom of the digester until the liquid separates from solids. The liquid then can be decanted by pump 18 to a storage area so the low pH liquid can be reused. This pumping action can be obtained by closing valves 28, 29*a*, 30*b*, and 31*b*.

Vapors which are given off during the process are collected by covering the digesters. The vapors are neutralized by sending them to mixer 20 where they are neutralized along with the microorganisms.

The treated coal fines slurry is neutralized by sequentially opening valves 23, 23*a*, 23*b*, and 23*c*, also opening valves 30*a*, 29*a*, 30*b*, and 31; closing valves 29, 30, 28, 28*a*, and 31*b*.

The pump 18 then pumps the low pH slurry to mixer 20. Here the treated sulphur free coal the low pH liquid is neutralized by adding a reagent. The reagent can be dry or a liquid hydrated lime, pebble lime, sodium hydroxide, or any other reagents cabable of raising the pH to 7 or above. As the slurry is pumped through mixer 20, the slurry is aerated and the reagent is fed in the mixer. The designed mixer aerates the slurry at the same time the reagent neutralizes any acid liquid in the slurry. The pH of 7 or above kills the bacteria as well as the aeration. The coal slurry or dewatered coal fines is now free of any harmful flue gases when used as a fuel, or sulphur free coke in steel making, or any other process using carbon.

The neutralized slurry is discharged in storage tank 21. Pump 22 pumps the sulphur-free coal slurry to dewatering and drying equipment 11*a* or 24 (centrifugal dryer or vacuum disc filters). A second stage (if required) can be disc or plate type filters (not shown) for coal dewatering plus sulphates removal. The product from the filters (minus 200 mesh coal at approximately 90 percent solids plus 10 percent moisture) would be in a useable state for plant requirements. The sulphur-free coal is the final product.

The effluent from the filter 24 can be sent to the make-up storage ponds 25 or flocation basin 26 where iron hydroxide, calcium sulphates and calcium carbonate would settle out, as shown in FIG. 2. Chlorides could also be removed in this circuit.

The precipitate from the settling basin 26 is removed and dewatered in filter 27 with the effluent going to the clear water pond and the dewatered sludge to landfill.

It will be seen that the present invention provides a speedy and more economical method of treating coal, starting at the mine and ending as sulphur-free coal fines useful for energy or other purposes.

While we have illustrated and described a single specific embodiment of our invention, it will be understood that this is by the way of illustration only and that various changes and modifications may be contemplated in our invention within the scope of the following claims:

We claim:

1. A method of purifying mined coal comprising pulverizing the coal, aerating by introducing said pulverized coal in a mixer and mixing it with the correct percentage of water and air to obtain an aerated coal slurry, adding a reagent at a mine site and mixing all ingredients simultaneously to facilitate a separation of clays and undersirable heavy materials from the pulverized coal, pumping the resulting slurry to a classifier, at said mine site, for the separation of the coal, from pyritic and organic sulphur and other high density material and pumping said pyritic and organic sulphur and other high density material to a waste area in said site; pumping the resulting coal slurry to a plant site another into mixer that proportionately adds bacteria and acid water and mixes the ingredients, then pumping the ingredients into a covered digester wherein the ingredients are recirculated to provide maximum contact of the bacteria and coal fines and dewatered, retaining the ingredients for a sufficient time to complete bacterial action, introducing the resulting sulphur-free coal slurry into a third mixer wherein the bacteria is neutralized by a reagent by raising the pH to above 7 to destroy the bacteria, and simultaneously aerating the resulting sulphur-free coal slurry to permit the treatment of the effluent, and finally recovering the dewatered sulphur-free coal by transfer to drying apparatus, providing purified coal whereby surface and atmospheric contamination at the mine and plant sites are minimized and the quality of the plant site environment is materially enhanced.

* * * * *